US006666900B2

(12) United States Patent
Chandaria

(10) Patent No.: US 6,666,900 B2
(45) **Date of Patent: *Dec. 23, 2003**

(54) SCENTED FIRELOG

(75) Inventor: Kapoor Chandaria, Nairobi (KE)

(73) Assignee: Conros Corporation, Ontario (CA)

( * ) Notice: Subject to any disclaimer, the term of this patent is extended or adjusted under 35 U.S.C. 154(b) by 339 days.

This patent is subject to a terminal disclaimer.

(21) Appl. No.: 09/765,908

(22) Filed: Jan. 22, 2001

(65) Prior Publication Data

US 2002/0056224 A1 May 16, 2002

Related U.S. Application Data

(63) Continuation of application No. 09/328,950, filed on Jun. 9, 1999, now Pat. No. 6,245,119.

(51) Int. Cl.[7] ..... C10L 5/00
(52) U.S. Cl. ..... 44/535
(58) Field of Search ..... 44/535

(56) References Cited

U.S. PATENT DOCUMENTS

| | | | | |
|---|---|---|---|---|
| 3,660,055 A | | 5/1972 | Haller | 44/6 |
| 5,858,036 A | | 1/1999 | Chandaria | 44/535 |
| 5,868,804 A | | 2/1999 | Williams et al. | 44/535 |
| 6,017,373 A | * | 1/2000 | Frisch | 44/535 |

* cited by examiner

*Primary Examiner*—Cephia D. Toomer
(74) *Attorney, Agent, or Firm*—Sand & Sebolt

(57) ABSTRACT

A scented artificial firelog includes combustible particulate material, binder material, and a plurality of scented pellets. The scented pellets produce a desirable scent as the pellets are incrementally heated by the gradual combustion of the firelog. The scented pellets are kernels of granular material that are impregnated with a scented liquid. The granular material is a porous, cellulosic material, and is preferred to be bird seed. As each scented pellet is heated by the incremental burning of the firelog, the scented liquid retained therein is heated and causes the kernel of granular material to explode, thus resulting in a pop being heard by the user, with the scent being simultaneously released by the scented pellet.

15 Claims, 3 Drawing Sheets

SCENTED FIRELOG

CROSS REFERENCE TO RELATED APPLICATION

This application is a continuation of U.S. patent application Ser. No. 09/328,950, filed Jun. 9, 1999 now U.S. Pat. No. 6,245,119.

BACKGROUND OF THE INVENTION

1. Technical Field

The invention relates generally to artificial firelogs and, more particularly, to an artificial firelog that produces a desirable scent as it burns. Specifically, the invention relates to an artificial firelog having a plurality of scented pellets distributed throughout the firelog that produce a desirable scent as they are periodically burned during combustion of the firelog.

2. Background Information

Various types of fuel bodies have been developed, most of which are formed of particulate flammable materials that are compressed into a predetermined shape. The particulate materials are combined with various binders that maintain the desired final shape of the fuel body. These fuel bodies may additionally contain various types of additives to enhance burning characteristics or to produce colored flames. Certain of these fuel bodies, and in particular the elongated fuel body referred to as a firelog, are formed of compressed sawdust, coal particles, or other combustible particulate materials. The particulate materials are combined with the binder materials to form a component mixture that is usually passed through a continuous extrusion process wherein the component mixture is compressed within an extrusion bore and is then cut into predetermined lengths to form artificial firelogs. The firelogs are then typically enclosed in a protective outer wrapper.

Artificial firelogs generate a desirable amount of heat and also create an aesthetically pleasing fire. Inasmuch as the vast majority of homes are built with furnaces or other heating appliances, artificial firelogs are desired for their aesthetic qualities to a greater extent than for their heat generation qualities. As such, much of the design and development efforts employed in producing firelogs are focused on the final aesthetic qualities of the artificial firelog. While various firelogs have achieved limited success with the aesthetic qualities they provide, such firelogs have not been without limitation.

Economically-priced artificial firelogs have heretofore been incapable of reliably producing a desirable scent while burning. Because artificial firelogs typically burn for several hours, a scent homogeneously distributed throughout the firelog would need to be formulated to burn at substantially the same rate as the particulate materials and binder materials to ensure that the scent-producing component would produce the desirable scent for the duration of the burning of the firelog. Moreover, a homogeneously distributed scent-producing material would need to produce a scent pungent enough to be smelled by the user as the firelog is slowly burned. Inasmuch as the scent-producing materials known and understood in the relevant art are substantially more expensive than the particulate material and binders used in manufacturing firelogs, the homogeneous distribution of the expensive scent-producing material in sufficient concentration that the user can smell the scent produced thereby for the duration of the burning of the firelog has been impractical due to the extreme expense involved. The need thus exists for an inexpensive artificial firelog that reliably produces a desirable scent that can be smelled by the user for substantially the duration of the combustion of the firelog.

SUMMARY OF THE INVENTION

In light of the foregoing, an objective of the present invention is to provide an artificial firelog that produces a desirable scent upon burning the firelog.

Another objective of the present invention is to provide an artificial firelog that produces a desirable scent for substantially the duration of the burning of the firelog.

Another objective of the present invention is to provide an artificial firelog that produces a scent that can be smelled by the user during combustion of the firelog.

Another objective of the present invention is to provide an artificial firelog having a plurality of scented pellets distributed throughout the firelog.

Another objective of the present invention is to provide an artificial firelog having scented pellets that produce a scent as they burn.

Another objective of the present invention is to provide an artificial firelog that periodically releases a substantial amount of scent.

Another objective of the present invention is to provide an artificial firelog that can be manufactured using existing manufacturing equipment.

Another objective of the present invention is to provide an artificial firelog that produces a desirable scent throughout its combustion and that can be fabricated at a relatively inexpensive price.

These and other objectives and advantages are obtained by the improved scented firelog of the present invention, the general nature of which may be stated as including a body formed from a combustible particulate material, a binder material, and a plurality of scented pellets.

Other objectives and advantages are obtained by the method of the present invention, the general nature of which may be stated as including the steps of admixing scented pellets with combustible particulate material and binder material to form a component mixture and forming the component mixture into a desired shape.

Still other objectives and advantages are obtained from the improvement of the present invention which can be said to relate to an artificial firelog of the type having a body formed from particulate combustible material and binder material, the improvement including scented pellets distributed throughout the firelog.

BRIEF DESCRIPTION OF THE DRAWINGS

The preferred embodiment of the invention, illustrative of the best mode in which applicant has contemplated applying the principles of the present invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

Figure 1:
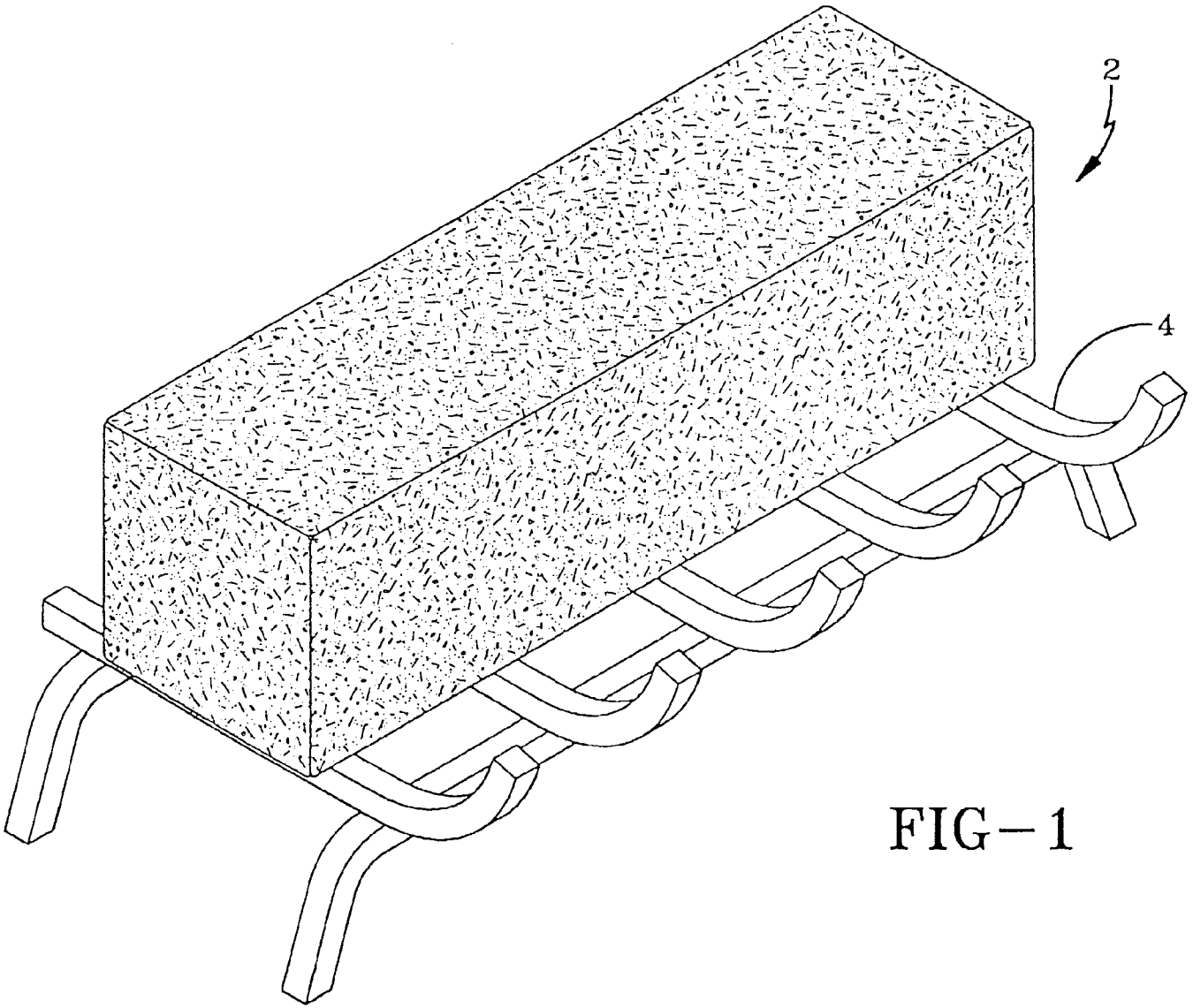
FIG. 1 is a pictorial view of the firelog of the present invention.
Figure 2:
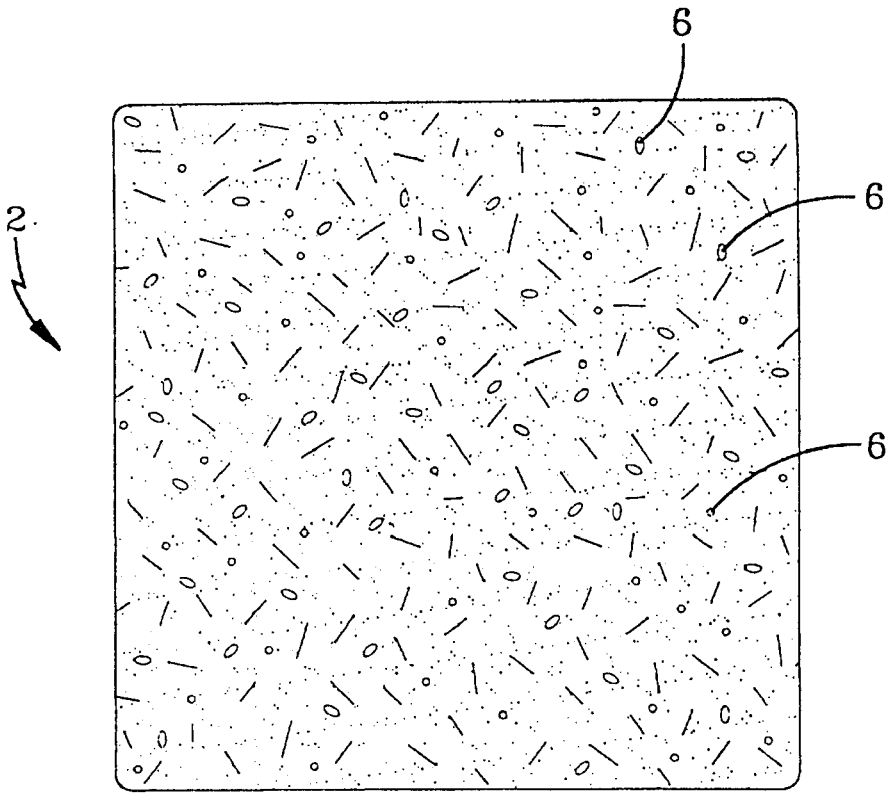
FIG. 2 is a side elevational view of the firelog of the present invention.
Figure 3:
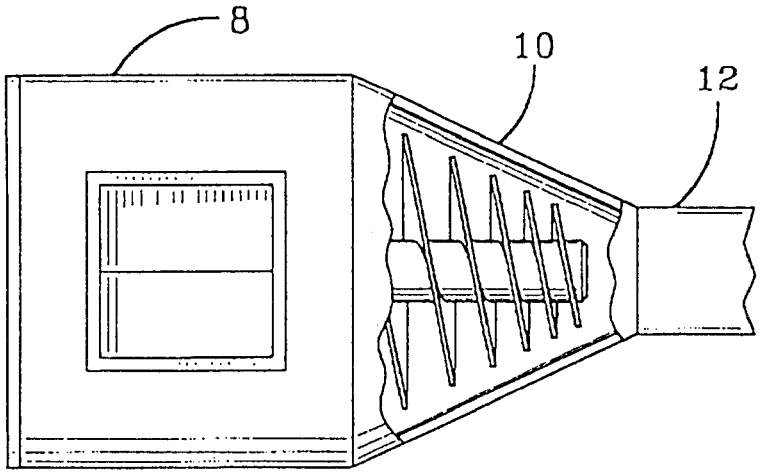
FIG. 3 is a top plan view, partially cut away, of a screw extruder that may be used to manufacture the firelog of the present invention.

The artificial firelog of the present invention is indicated generally at the numeral 2 in FIGS. 1 and 2. Firelog 2 is placed on a grate 4 that is preferably located within a fireplace and is ignited by a match or other flame source. Once firelog 2 has been ignited, it burns slowly until only an ash remains. As firelog 2 burns, it generates heat and light and produces a desirable scent that can be smelled by the consumer. The desirable scent is produced over substantially the duration of the burning of the firelog.

Firelog 2 is manufactured by preparing a component mixture and processing the component mixture through an extrusion bore, although it is understood that any of a variety of appropriate processes may be used to form the component mixture into a desired final shape. The component mixture is prepared by admixing combustible particulate material with an appropriate binder and desired additive materials. In the preferred embodiment, the combustible particulate material is wood chips, pulverized coal, nutshells, or other particulate combustible material of the type known and understood in the relevant art. It is preferred that the combustible particulate material also comprise materials that are readily available and inexpensive and are most preferably a waste product such as sawdust.

The binder material is any one of a variety of known combustible materials such as various slack waxes, oils, or molasses, although other appropriate binder materials known and understood in the relevant art may be used without departing from the spirit of the present invention. While it is preferred that the binder material be combustible, it is understood that appropriate non-combustible binders may be used in certain applications without departing from the spirit of the present invention so long as they do not interfere with the proper combustion of firelog 2. As is understood in the relevant art, it is most typically preferred that the component mixture include only so much of the binder as is required to maintain the desired final shape of the combustible particulate material and scented pellets 6, although quantities of binder material in excess of this may be appropriate in certain circumstances depending upon the particular needs of the application and the desired final burning characteristics of firelog 2.

While various appropriate additive materials may be included in firelog 2 to enhance burning characteristics, to produce colored flames, or for other purposes, the additive materials of the present invention include a quantity of scented pellets 6. In accordance with the objectives of the present invention, scented pellets 6 are admixed with the combustible particulate material and the binder to form the component mixture, such that scented pellets 6 are substantially evenly distributed throughout the component mixture. Scented pellets 6 are admixed with the combustible particulate material and the binder in a mixing hopper 8 to form the component mixture. The component mixture is then pushed by a screw extruder 10 through an extrusion bore 12 that forms the longitudinal outer surface of firelog 2.

After the component mixture has exited extrusion bore 12, it is cut to desired lengths to form firelog 2. As is understood in the relevant art, firelog 2 is typically then wrapped in a protective wrapper and delivered to the customer. As is shown in FIGS. 1 and 2, extrusion bore 12 imparts to firelog 2 a generally rectangular cross section, although firelog 2 can have virtually any cross section without departing from the spirit of the present invention.

In the preferred embodiment, scented pellets 6 are manufactured by heavily impregnating a quantity of granular material 14 with a scented liquid 16. Granular material 14 may be any of a variety of seeds known and understood in the relevant art such as common bird seed, millet, thistle seed, as well as other seeds. Granular material 14 may likewise be any of a variety of grains such as rice, rye, cumin, as well as other grains. While it is preferred that granular material 14 be of a single and generally consistent particle size, combinations of different types of seed and grain having different sizes and shapes may be used as desired without departing from the spirit of the present invention.

Granular material 14 is a cellulosic, generally porous material of a generally spherical or elongated shape and is readily combustible. In accordance with the objectives of the present invention, granular material 14 is sufficiently porous to absorb an appropriate quantity of scented liquid 16 during an impregnation process 17. Scented liquid 16 may be any of a variety of water-based or oil-based scents that are well suited to being absorbed by granular material 14 in appropriate quantities as will be set forth more fully below.

Scented liquid 16 produces any of a variety of desirable scents, such as that of a pine forest, lilac, vanilla, or any other appropriate and desirable scent. Moreover, the scent-producing components of scented liquid 16 are substantially impervious to heat, meaning that the heat produced in the combustion of firelog 2 does not cause the breakdown or other destruction of the scent-producing components of scented liquid 16.

Figure 4:
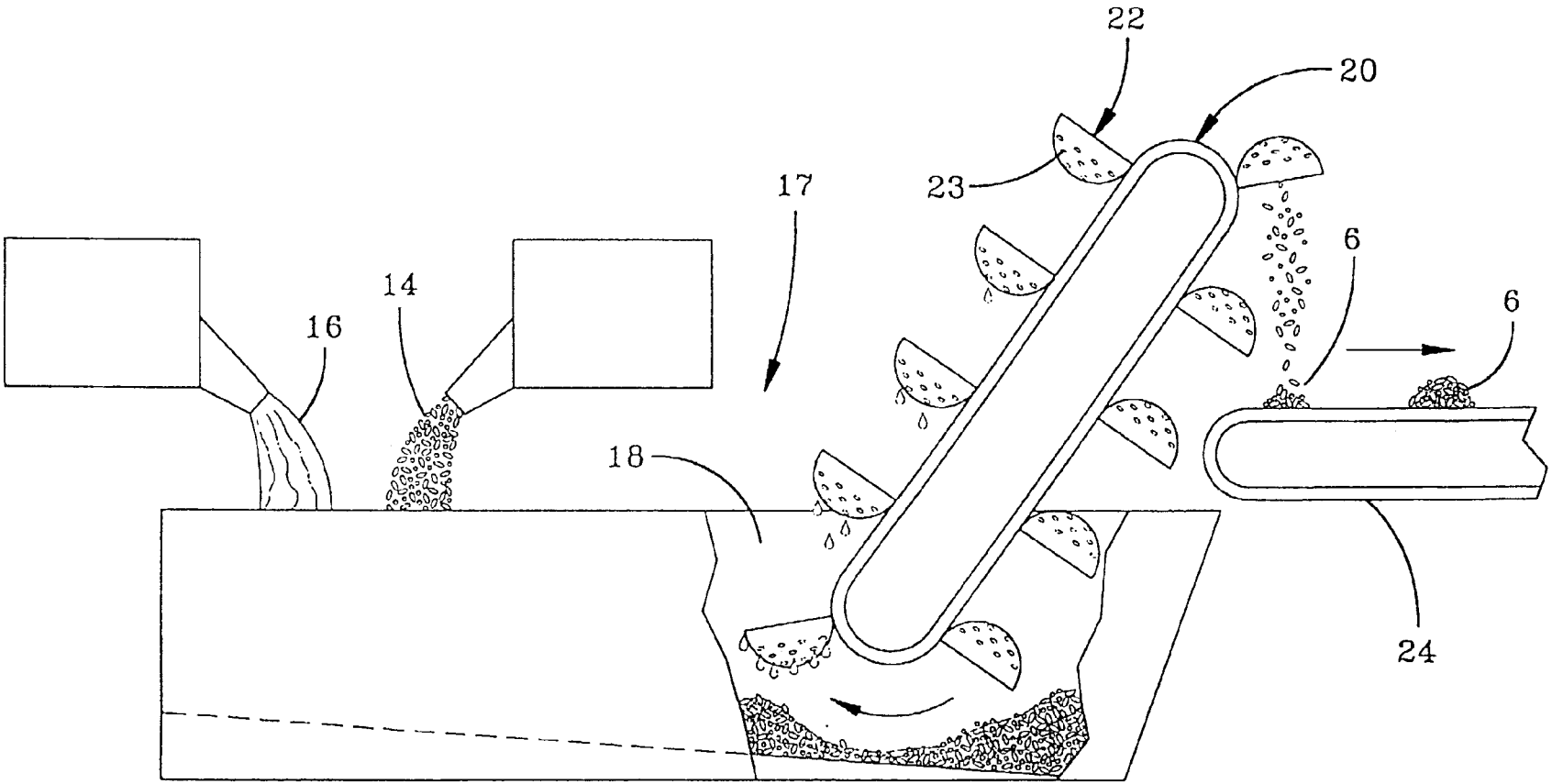
FIG. 4 is a diagrammatic view of a process for manufacturing scented pellets.

Impregnation process 17 impregnates granular material 14 with scented liquid 16. Specifically, and as is best shown in FIG. 4, granular material 14 and scented liquid 16 are admixed in a trough 18. Inasmuch as granular material 14 is porous and is soaked in scented liquid 16, granular material 14 absorbs an amount of scented liquid 16. Trough 18 is preferably constructed to direct granular material 14 toward an angled conveyor 20 that carries a plurality of perforated buckets 22. Angled conveyor 20 is an endless conveyor constructed of chains, mesh, rubber, or other appropriate material that rotates about a pair of end rollers. Perforated buckets 22 each are formed with a plurality of holes 23 that are smaller than the individual kernels of granular material 14, yet are large enough to permit excess scented liquid 16 to flow therethrough.

In operation, the translational operation of angled conveyor 20 causes perforated buckets 22 to scoop quantities of granular material 14 from trough 18. Holes 23 in perforated buckets 22 permit the excess scented liquid 16 to drip from granular material 14 while retaining granular material 14 within perforated buckets 22. As can be seen in FIG. 4, angled conveyor 20 is configured to allow substantially all of the excess scented liquid 16 to drip from granular material 14 before granular material 14 is deposited onto a belt conveyor 24. Inasmuch as scented liquid 16 is a relatively expensive component of firelog 2, it is preferred that trough 18 and angled conveyor 20 are configured to permit the excess portion of scented liquid 16 that drips from perforated buckets 22 to drip back into trough 18 where it can be reused to impregnate other granular material 14.

Once the excess portion of scented liquid 14 has dripped from granular material 14, the scent-carrying granular material 14 constitute the scented pellets 6 that are admixed with the combustible particulate material and the binder to form the component mixture that is shaped to form firelog 2. While impregnation process 17 illustrates one method for impregnating granular material 14 with scented liquid 16, it is understood that virtually any process can be employed to perform the impregnation, such as those employing spraying or pressure treatment, without departing from the spirit of the present invention. It is preferred, however, that such processes recover the excess portion of the relatively expensive scented liquid 16 that is not absorbed by granular material 14.

Additionally, it is further understood that scented pellets 6 may be produced in fashions other than by impregnating granular material 14 with scented liquid 16 without departing from the spirit of the present invention. For instance, granular material 14 may be surface-coated with a powdered or liquid material that produces a scent when burned. Alternatively, scented liquid 16 may be encapsulated within a shell of a cellulosic material or plastic. Still alternatively, scented pellets 6 may be formed by a powdered scented material that is pressed into a granular form to produce scented pellets 6.

When granular material 14 is impregnated with scented liquid 16 by impregnation process 17, the resultant scented pellets 6 will be approximately one half scented liquid 16 and one half granular material 14 by weight. It is understood, however, that the relative proportion of scented liquid 16 to granular material 14 can vary significantly depending upon the type, size, and porosity of granular material 14, the physical characteristics of scented liquid 16, whether oil-based or water-based, the duration of time that granular material 14 is soaked within trough 18, and other relevant factors. It is understood that the quantity of scented liquid 16 carried by each kernel of granular material 14 can be varied as needed by selecting granular material 14 having desired characteristics of size and porosity and by varying the duration of time that granular material 14 is soaked with scented liquid 16 within trough 18, as well as by varying other factors. As such, scented pellets 6 can have nearly any proportion of scented liquid 16 contained therein without departing from the spirit of the present invention.

Scented pellets 6 preferably make up approximately 1 to 10 percent of the total weight of firelog 2, although scented pellets 6 can make up lesser and greater proportions of firelog 2 without departing from the spirit of the present invention. The proportion of scented pellets 6 in firelog 2 is a function of the desired pungence of the scent produced by firelog 2 during combustion and the quantity of scented liquid 16 carried by each scented pellet 6, as well as the concentration of the scent-producing components within scented liquid 16. The manufacturer of firelog 2 may, for instance, desire to produce firelog 2 in various configurations, with each configuration producing a scent of a different pungence suited to different sized rooms. It is understood that the manufacturer of firelog 2 can provide firelog 2 with any desired level of pungence depending upon the particular requirements of the application such as the desired overall effect of firelog 2, the size of the room in which firelog 2 is burned, as well as other requirements.

Scented pellets 6 are preferably substantially evenly distributed throughout firelog 2. When ignited, firelog 2 burns gradually from the outer surface inward over the course of several hours. As the combustible particulate material of firelog 2 gradually burns, the scented pellets 6 in the vicinity of the burning portion of firelog 2 are heated, thus releasing the desired scent therefrom. In accordance with the objectives of the present invention the scent-containing scented pellets 6 retain the scent until burned. As firelog 2 burns, therefore, it periodically produces puffs of scent that can be perceived by the user over the duration of the combustion of firelog 2. The retention of scented liquid 16 within scented pellets 6 prevents scented liquid 16 from evaporating during the initial combustion of firelog 2 and thus ensures that the desired scent will be produced for the entire duration of the combustion of firelog 2.

As described above, the gradual combustion of firelog 2 causes the scented pellets 6 adjacent the combusting portions of firelog 2 to be heated, likewise causing the scented liquid 16 retained within the particular scented pellets 6 to be heated to the point of evaporation. A scented pellet 6 explodes once the scented liquid 16 contained therein has been heated to the point of evaporation, thus releasing all at once the evaporated scented liquid 16 contained therein and causing a popping sound. The popping sound created by the miniature explosions of the heated scented pellets 6 further adds to the aesthetic appeal of firelog 2. Moreover, inasmuch as each pop is accompanied by an incremental increase in the scent produced by firelog 2, the explosion of scented pellets 6 appeals to both the auditory and olfactory senses. Furthermore, firelog 2 makes efficient use of the relatively expensive scented liquid 16 by retaining scented liquid 16 in small capsules that release the scent only when heated.

The encapsulation of scented liquid 16 thus permits firelog 2 to produce a scent that can be smelled by the user while using less scented liquid 16 than would be required if scented liquid 16 were simply homogeneously admixed with the combustible particulate material and the binder material of firelog 2 as in the past. It is understood, of course, that scented pellets 6 may be configured to release a scent upon heating without requiring that the evaporation of scented liquid 16 cause scented pellets 6 to explode with a pop.

Accordingly, the improved scented firelog apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the scented firelog is constructed and used, the characteristics of the construction, and the advantageous new and useful results obtained; the new and useful structures, devices, elements, arrangements, parts, and combinations are set forth in the appended claims.

I claim:

1. a scented artificial firelog comprising:

a body formed from a combustible particulate matter;

a binder material; and a plurality of scented pellets, wherein said scented pellets have a scent applied to them and the scented pellets make up a sufficient portion of the firelog to produce a scent that can be smelled by a user when the firelog is heated.

2. The firelog as set forth in claim 1, wherein said scented pellets include a scented material.

3. A method for manufacturing a scented artificial firelog comprising the steps of:

applying a scent to pellets;

admixing said scented pellets with combustible particulate material and binder material to form a component mixture; and forming the component mixture into a desired shape, wherein said scented pellets make up a sufficient proportion of the firelog to produce a scent that can be smelled by a user when the firelog is heated.

4. A method as set forth in claim 3, wherein the scent to be applied is selected from the group consisting of lilac and vanilla.

5. A method as set forth in claim 3, wherein the scent to be applied is lilac.

6. A method as set forth in claim 3, wherein the scent to be applied is vanilla.

7. In an artificial firelog of the type having a body formed from particulate combustible material and binder material, the improvement comprising:

scented pellets distributed throughout the body, wherein said scented pellets have a scent applied to them, and said scented pellets make up a sufficient proportion of the firelog to produce a scent that can be smelled by a user when the firelog is heated.

8. A method as set forth in claim 7, wherein the scent to be applied is selected from the group consisting of lilac and vanilla.

9. A method as set forth in claim 7, wherein the scent to be applied is lilac.

10. A method as set forth in claim 7, wherein the scent to be applied is vanilla.

11. A scented artificial firelog comprising:

a body formed from a combustible particulate matter;

a binder material; and a plurality of scented pellets, wherein said scented pellets make up a sufficient portion of the firelog to produce a pleasant scent that can be smelled by a user when the firelog is heated.

12. A scented artificial firelog as set forth in claim 11, wherein the scent is applied to the scented pellets.

13. A scented artificial firelog as set forth in claim 12, wherein the scent is selected from the group consisting of lilac and vanilla.

14. A scented artificial firelog as set forth in claim 12, wherein the scent selected is lilac.

15. A scented artificial firelog as set forth in claim 12, wherein the scent selected is vanilla.

* * * * *